US009157436B2

(12) United States Patent
Izutsu et al.

(10) Patent No.: US 9,157,436 B2
(45) Date of Patent: Oct. 13, 2015

(54) VARIABLE OIL PUMP WITH IMPROVED PARTITIONING SECTION

(71) Applicant: YAMADA MANUFACTURING CO., LTD, Kiryu-shi (JP)

(72) Inventors: Masato Izutsu, Isesaki (JP); Takatoshi Watanabe, Isesaki (JP)

(73) Assignee: YAMADA MANUFACTURING CO., LTD., Kiryu-Shi, Gunma (JP)

( * ) Notice: Subject to any disclaimer, the term of this patent is extended or adjusted under 35 U.S.C. 154(b) by 21 days.

(21) Appl. No.: 13/943,656

(22) Filed: Jul. 16, 2013

(65) Prior Publication Data

US 2014/0023539 A1 Jan. 23, 2014

(30) Foreign Application Priority Data

Jul. 18, 2012 (JP) ..... 2012-159887

(51) Int. Cl.

| | |
|---|---|
| ***F04C 2/10*** | (2006.01) |
| ***F04C 14/22*** | (2006.01) |
| ***F04C 2/08*** | (2006.01) |
| ***F04C 15/06*** | (2006.01) |
| ***F04C 14/12*** | (2006.01) |

(52) U.S. Cl.

CPC ..... *F04C 14/22* (2013.01); *F04C 2/084* (2013.01); *F04C 2/102* (2013.01); *F04C 14/12* (2013.01); *F04C 15/06* (2013.01); *F04C 2250/102* (2013.01)

(58) Field of Classification Search

CPC ..... F04C 2/10
USPC ..... 418/160, 16, 19, 29, 30, 31
IPC ..... F04C 2/10
See application file for complete search history.

(56) References Cited

U.S. PATENT DOCUMENTS

| | | | | | |
|---|---|---|---|---|---|
| 2,373,368 | A * | 4/1945 | Witchger | ..... | 418/32 |
| 4,492,539 | A * | 1/1985 | Specht | ..... | 418/19 |
| 6,126,420 | A * | 10/2000 | Eisenmann | ..... | 418/19 |
| 2011/0014078 | A1 * | 1/2011 | Ono et al. | ..... | 418/166 |

FOREIGN PATENT DOCUMENTS

| | | | | | |
|---|---|---|---|---|---|
| JP | 63001781 | A * | 1/1988 | ..... | F04C 15/04 |
| JP | 08-159046 | A | 6/1996 | | |
| JP | 2010-096011 | A | 4/2010 | | |
| JP | 2010096011 | A * | 4/2010 | | |
| WO | WO 2010/013625 | A1 | 2/2010 | | |

OTHER PUBLICATIONS

Machine Translation of Japanese Patent Publication JPH 08-159046 A, Inventor: Kosaka, Jun. 18, 1996.*
European Search Report dated Jul. 21, 2015.

* cited by examiner

*Primary Examiner* — Mary A Davis
(74) *Attorney, Agent, or Firm* — McGinn IP Law Group, PLLC.

(57) ABSTRACT

A oil pump includes a pump housing in which a first partitioning section is formed between a trailing end section of the intake port and a leading end section of the discharge port, and a second partitioning section is formed between a trailing end section of a discharge port and a leading end section of an intake port. A width dimension of the second partitioning section is the same as or larger than the formation range of a space between teeth which is constituted by an inner rotor and an outer rotor passing the second partitioning section during low-speed rotation. A protruding surface section is formed in the same plane as and continuously with the second partitioning section from the vicinity of an inner diameter side of the trailing end section of the discharge port.

9 Claims, 5 Drawing Sheets

ENLARGEMENT OF PART (α)

DURING LOW-SPEED ROTATION
(BEFORE ECCENTRICITY OF OUTER ROTOR)

DURING HIGH-SPEED ROTATION
(AFTER ECCENTRICITY OF OUTER ROTOR)

VARIABLE OIL PUMP WITH IMPROVED PARTITIONING SECTION

BACKGROUND OF THE INVENTION

1. Field of the Invention

The present invention relates to an oil pump in which the discharge volume is varied between low-speed rotation and high-speed rotation of rotors due to rotation of a reference line linking a center of an inner rotor and a center of an outer rotor, and in which the pump efficiency can be improved.

2. Description of the Related Art

Conventionally, there is an internal gear type of oil pump in which the pump discharge volume can be varied by rotational movement of a reference line which is a line linking the center of the inner rotor and the center of the outer rotor. Examples of this type of pump are disclosed in Domestic re-publication of PCT international application WO 2010/013625 and Japanese Patent Application Publication No. 2010-96011. Below, the oil pump disclosed in Domestic re-publication of PCT international application WO 2010/013625 and Japanese Patent Application Publication No. 2010-96011 will be described in general terms. In the description, the reference symbols employed in Domestic re-publication of PCT international application WO 2010/013625 and Japanese Patent Application Publication No. 2010-96011 are used as is without alteration.

The eccentric variable-capacity pump which is disclosed in Domestic re-publication of PCT international application WO 2010/013625 is provided with guide means G for setting an attitude of an adjusting ring 14 fitted externally onto an outer rotor 13, by causing rubbing contact of a contact section C of the adjusting ring 14 against a guide surface S of a casing 1 (see FIG. 2 in Domestic re-publication of PCT international application WO 2010/013625).

The guide means G includes a first guide pin 21 and a second guide pin 22 which pass through a first arm section C1 and a second arm section C2 formed on the adjusting ring 14, in a parallel attitude with respect to a driving rotation axis center X, and includes a circular arc-shaped first guide groove T1 and a circular arc-shaped second guide groove T2 formed in a wall section 1A of the casing 1, in accordance with the first guide pin 21 and the second guide pin 22.

The first guide groove T1 and the second guide groove T2 are formed into a shape whereby when the adjusting ring 14 moves, a driven axis Y performs an orbiting motion about the drive rotation axis center X, while at the same time the adjusting ring 14 performs a rotating motion about the idle axis center Y.

Furthermore, conventionally, there is an internal gear type oil pump in which a shallow groove is formed on a seal land which is formed between a trailing end section of a discharge port and a leading end section of an intake port. In the oil pump disclosed in Japanese Patent Application Publication No. 2010-96011, a groove 11a is provided in a small seal land so as to extend in the forward direction of rotation of the rotor from the outer diameter side of the rotor of the trailing end of the discharge port 7 (see FIG. 1 and FIG. 3 in Japanese Patent Application Publication No. 2010-96011).

Due to a liquid pressure being introduced from the groove 11a into a space g at a position where the volume of the pump chamber 10 is smallest, thereby pressing together the teeth of the outer rotor 3 and the inner rotor 2 on opposite sides half a cycle apart, the tip clearance between the rotors is compressed and the amount of liquid leakage via the tip clearance is reduced (see FIG. 4A in Japanese Patent Application Publication No. 2010-96011).

Connection between the pump chamber 10 and both the intake port 6 and the discharge port 7 needs to be shut off between the discharge finish point and the intake start point, and in order to ensure this function even when the groove 11a is provided, an escape section 12 is formed, which causes one portion of the outer circumferential side of the rotor at the leading end of the intake port 6 to be displaced in the forward direction of rotation of the rotor (see FIG. 3 in Japanese Patent Application Publication No. 2010-96011).

SUMMARY OF THE INVENTION

In the oil pump disclosed in Japanese Patent Application Publication No. 2010-96011, a groove 11a is formed at the trailing end of the discharge port 7 and an escape section 12 is formed at the leading end of the intake port 6, and hence there is a large number of processing points and the costs are high. Furthermore, by forming an escape section 12 at a leading end of the intake port 6, the angle and surface area of the intake port 6 are reduced and therefore not all of the oil is taken in, the oil intake volume is reduced and hence there is a risk of decline in the pump performance.

Moreover, if the oil pump disclosed in Japanese Patent Application Publication No. 2010-96011 is employed in the eccentric type of variable-capacity pump disclosed in Domestic re-publication of PCT international application WO 2010/013625, during high-speed rotation, the space g which positioned on the seal land formed between the discharge port trailing end section and the intake port trailing end section connects with the discharge port 7 and the intake port 6. Therefore, oil leaks out and the pump performance declines.

The object of the present invention (the technical problem to be solved by the invention) is to improve pump efficiency in an internal gear pump of a variable-capacity type which is constituted by an inner rotor and an outer rotor with which the inner rotor makes internal contact.

Therefore, as a result of thorough on-going research in order to achieve the object described above, the object described above was achieved by forming a first aspect of the present invention as an oil pump which changes an amount of fluid transferred from an intake port to a discharge port in one rotation, by causing rotation of a reference line linking centers of rotation of an inner rotor and an outer rotor, the oil pump including a pump housing in which a second partitioning section is formed between a trailing end section of the discharge port and a leading end section of the intake port; wherein a width dimension of the second partitioning section is formed to be the same as or slightly larger than a formation range of a space between teeth which is constituted by the inner rotor and the outer rotor passing the second partitioning section during low-speed rotation; a protruding surface section is formed in a same plane as and continuously with the second partitioning section from the vicinity of an inner diameter side of the trailing end section of the discharge port; and the protruding surface section and the second partitioning section are formed to be the same as or slightly larger than the formation range of the space between teeth which passes the protruding surface section and the second partitioning section during high-speed rotation.

The object described above is resolved by forming a second aspect of the present invention as the oil pump according to the first aspect, wherein the protruding surface section is formed into a shape following a path of travel of a contact point between the teeth of the inner rotor and the outer rotor on a rear side in a direction of rotation of the rotors when the space between teeth which is constituted by the inner rotor and the outer rotor passes the second partitioning section during high-speed rotation.

The object described above is resolved by forming a third aspect of the present invention as the oil pump according to the first aspect, wherein the protruding surface section is formed into a substantially quadrangular shape. The object described above is resolved by forming a fourth aspect of the present invention as the oil pump according to the first aspect, wherein the protruding surface section is formed into a substantially triangular shape.

In the first aspect of the present invention, a protruding surface section is formed in a same plane as and continuously with the second partitioning section from the vicinity of an inner diameter side of the trailing end section of the discharge port; and the protruding surface section and the second partitioning section are formed to be the same as or slightly larger than the formation range of the space between teeth which passes the protruding surface section and the second partitioning section during high-speed rotation. By adopting a composition of this kind, it is possible to prevent the occurrence of a connection between the discharge port and the intake port via the space between teeth, when the space between teeth which is constituted by the inner rotor and the outer rotor during high-speed rotation passes the second partitioning section.

Consequently, it is possible to reduce the discharge flow volume during high-speed rotation with respect to during low-speed rotation, without decline in the pump efficiency due to the space between the teeth passing the second partitioning section. Furthermore, rather than increasing the range of the second partitioning section, in the present invention, the protruding surface section is formed to a necessary size, in the vicinity of the inner diameter side of the trailing end section of the discharge port.

In other words, the protruding surface section should have a breadth extending along the direction of rotation which enables the passage of the portion of the space between teeth that projects beyond the second partitioning section during high-speed rotation. Accordingly, since there is no overall increase in the size of the second partitioning section, it is possible to achieve smooth rotation of the inner rotor and the outer rotor without increase in the friction when the inner rotor and the outer rotor pass the second partitioning section, and therefore it is possible to improve the pump efficiency.

Moreover, since no processing is required on the leading end section side of the intake port, then the manufacturing costs can be kept low. Furthermore, the effective formation angle of the intake port is not reduced, a sufficient surface area is achieved, the oil intake volume is maintained, and decline in the pump efficiency can be prevented.

In the second aspect of the present invention, the size of the protruding surface section can be minimized by forming the protruding surface section in a shape following the path of travel of the contact point between the teeth of the inner rotor and the outer rotor on the rear side in the direction of rotation of the rotors when the space between teeth which is constituted by the inner rotor and the outer rotor passes the second partitioning section during high-speed rotation. Therefore, the manufacturing costs can also be kept to a minimum.

In the third aspect of the present invention, the protruding surface section has a simple shape and can be processed easily due to being formed into a substantially quadrangular shape. The fourth aspect of the present invention displays substantially similar beneficial effects to the third aspect of the invention.

DESCRIPTION OF THE PREFERRED EMBODIMENTS

Figure 1A:
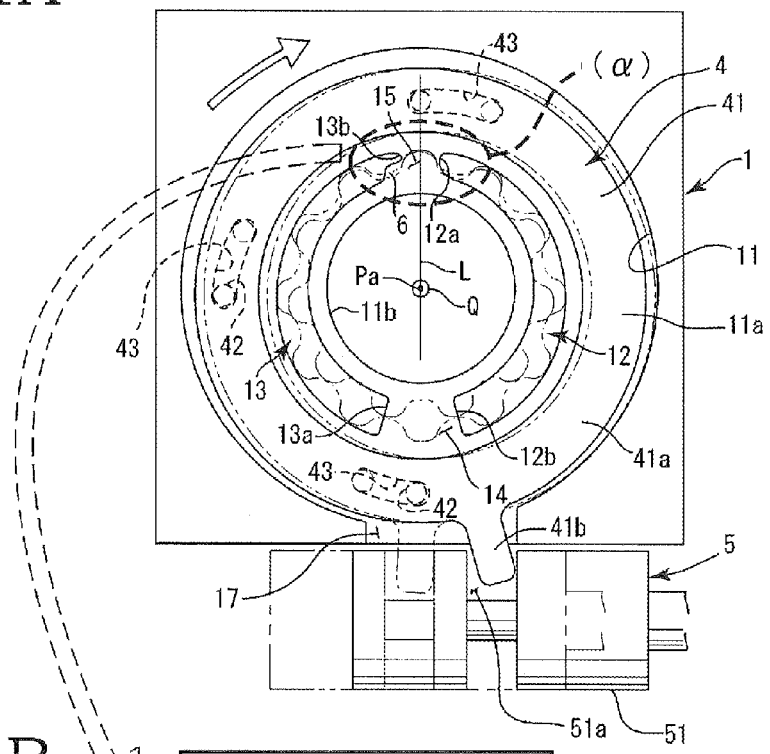
FIG. 1A is a front view diagram according to the present invention.

Below, an embodiment of the present invention will be described with reference to the drawings. The present invention relates to an oil pump of a variable-capacity type. The amount of fluid which is transferred from an intake port 12 to a discharge port 13 is changed, in other words, the capacity is varied, due to a reference line L, which is a line linking a center of rotation Pa of an inner rotor 2 and a center of rotation Pb of an outer rotor 3, being rotated about the center of rotation Pa of the inner rotor 2 by a guide mechanism 4.

Figure 4A:
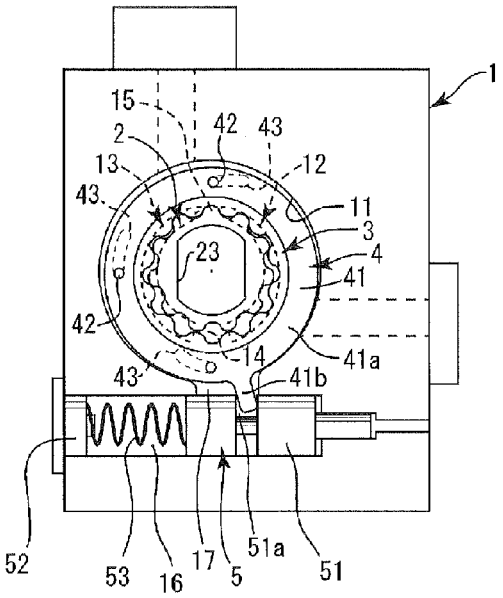
FIG. 4A is a front view diagram including a pump housing according to the present invention.
Figure 4B:
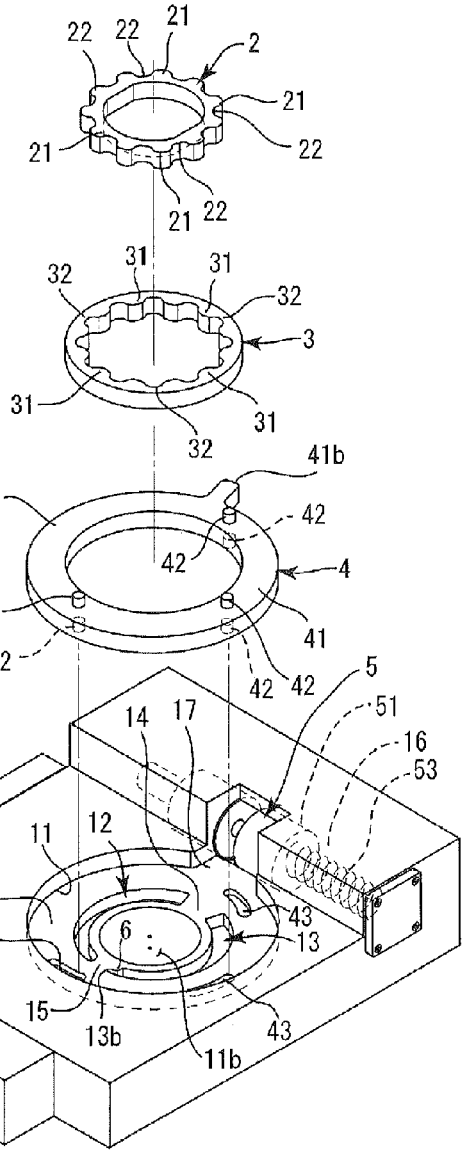
FIG. 4B is an exploded perspective diagram of the present invention.
Figure 4C:
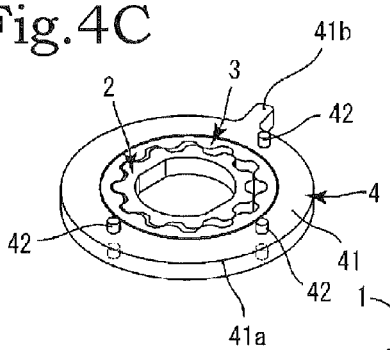
FIG. 4C is a perspective diagram showing the inner rotor, the outer rotor and the outer ring is an assembled state.

As shown in FIG. 1 and FIG. 4, the present invention is mainly constituted by a pump housing 1, the inner rotor 2, the outer rotor 3, the guide mechanism 4 and an adjustment mechanism 5. As shown in FIG. 4, a rotor chamber, 11 and an adjustment mechanism accommodating section 16 are formed in the pump housing 1. An axle hole 11*b* into which a drive axle for driving the pump is installed is formed in a bottom surface section 11*a* of the rotor chamber 11, and the intake port 12 and the discharge port 13 are formed about the periphery of the axle hole 11*b*.

An inner rotor 2, an outer rotor 3 and an outer ring 41 which forms a guide mechanism 4 are installed in the rotor chamber 11 (see FIGS. 4A and 4B). Furthermore, a member, or the like, which constitutes an adjustment mechanism 5 for operating the outer ring 41 is installed in the adjustment mechanism accommodating section 16. The rotor chamber 11 and the adjustment mechanism accommodating section 16 are connected via a connecting chamber 17.

The intake port 12 and the discharge port 13 are formed in the rotor chamber 11 near the outer circumference thereof and along the circumferential direction of the chamber (see FIG. 1). An end section of the intake port 12 where a space between teeth S formed by the rotation of the inner rotor 2 and the outer rotor 3 described below arrives first in the region of the intake port 12, due to the movement of the space between teeth S, is called a leading end section 12*a* of the intake port 12, and an end section of the intake port 12 where the space between teeth S arrives last in the region of the intake port 12 due to rotation is called a trailing end section 12*b*.

Similarly, an end section of the discharge port 13 where the space between teeth S formed by the rotation of the inner rotor 2 and the outer rotor 3 arrives first in the region of the discharge port 13 due to the movement of the space between teeth S, is called a leading end section 13*a* of the discharge port 13, and an end section of the discharge port 13 where the space between teeth S arrives last in the region of the discharge port 13 due to rotation is called a trailing end section 13*b*.

A partitioning section 11 is formed between the intake port 12 and the discharge port 13. The partitioning section is formed in two locations. One partitioning section is positioned between the trailing end section 12*b* of the intake port 12 and the leading end section 13*a* of the discharge port 13, and this partitioning section 11 is called a first partitioning section 14. Furthermore, another partitioning section is positioned between the trailing end section 13*b* of the discharge port 13 and the leading end section 12*a* of the intake port 12, and this partitioning section is called a second partitioning section 15.

The front surfaces of the first partitioning section 14 and the second partitioning section 15 are both flat surfaces. The first partitioning section 14 is a partitioning surface which closes in the fluid that has been filled into the space between teeth S via the intake port 12, while transferring the fluid to the side of the discharge port 13. The second partitioning section 15 is a partitioning surface which moves the inner rotor 2 and the outer rotor 3 that have completed discharge on the side of the discharge port 13, to the side of the intake port 12.

Figure 1B:
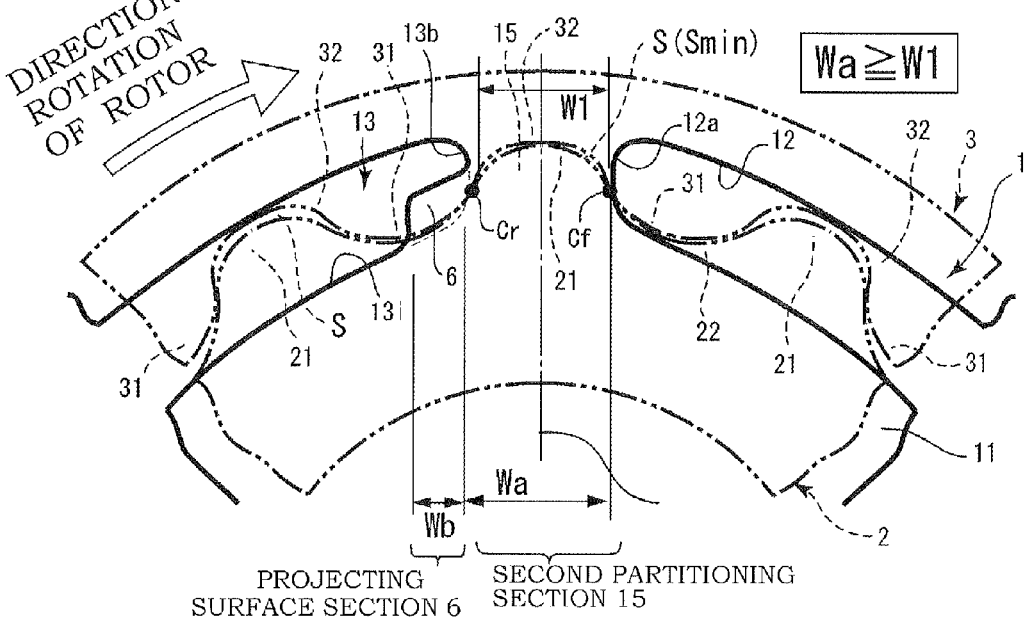
FIG. 1B is an enlarged diagram of portion (a) in FIG. 1A.
Figure 2A:
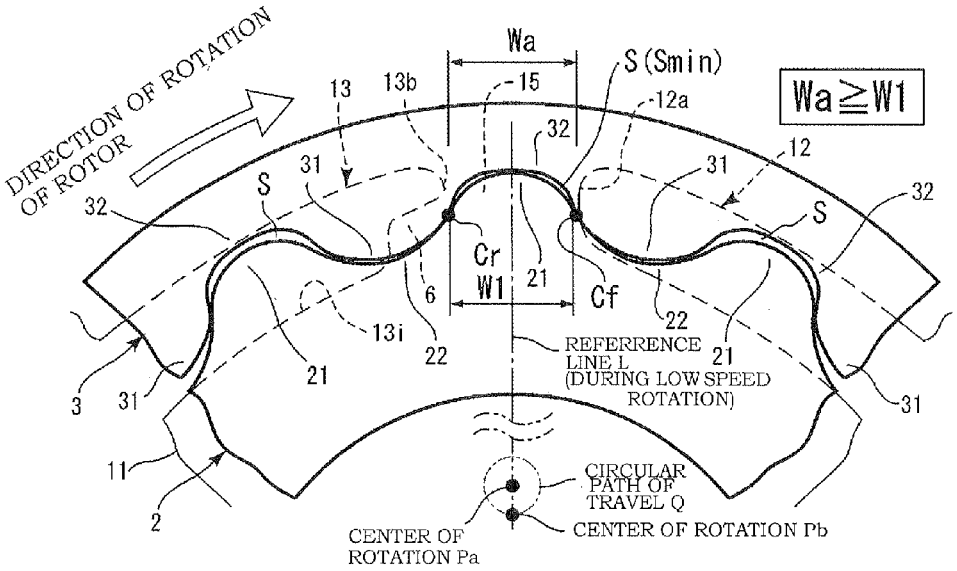
FIG. 2A is a principal enlarged diagram showing a space between teeth which is constituted by an inner rotor and an outer rotor, and a second partitioning section, during low-speed rotation in the present invention.

The inner rotor 2 is substantially a gear type of rotor, in which a plurality of outer teeth, 21 are formed (see FIG. 1, FIG. 2, and so on). Furthermore, the bottom sections between mutually adjacent outer teeth 21, are called tooth valleys 22. A boss hole 23 for a drive axle is formed in the inner rotor 2, and a drive axle is passed through the boss hole 23 and fitted therein.

The boss hole 23 is formed into a non-circular shape, or is formed with key grooves, and the like. Furthermore, the drive axle is fixed to the inner rotor 2 by fixing means, such as pressure fitting, and the inner rotor 2 rotates due to the rotational driving of the drive axle. The outer rotor 3 is formed into a ring shape, and a plurality of inner teeth 31 are formed on an inner circumferential side thereof. Furthermore, the bottom sections between mutually adjacent inner teeth 31 are called tooth valleys 32.

The number of outer teeth 21 on the inner rotor 2 is one fewer than the number of inner teeth 31 on the outer rotor 3. The relationship between the inner rotor 2 and the outer rotor 3 is such that when the inner rotor 2 rotates once, the outer rotor 3 rotates with a relative one-tooth delay. A plurality of spaces between teeth S are constituted by the outer teeth 21 of the inner rotor 2 and the inner teeth 31 of the outer rotor 3.

Figure 5A:
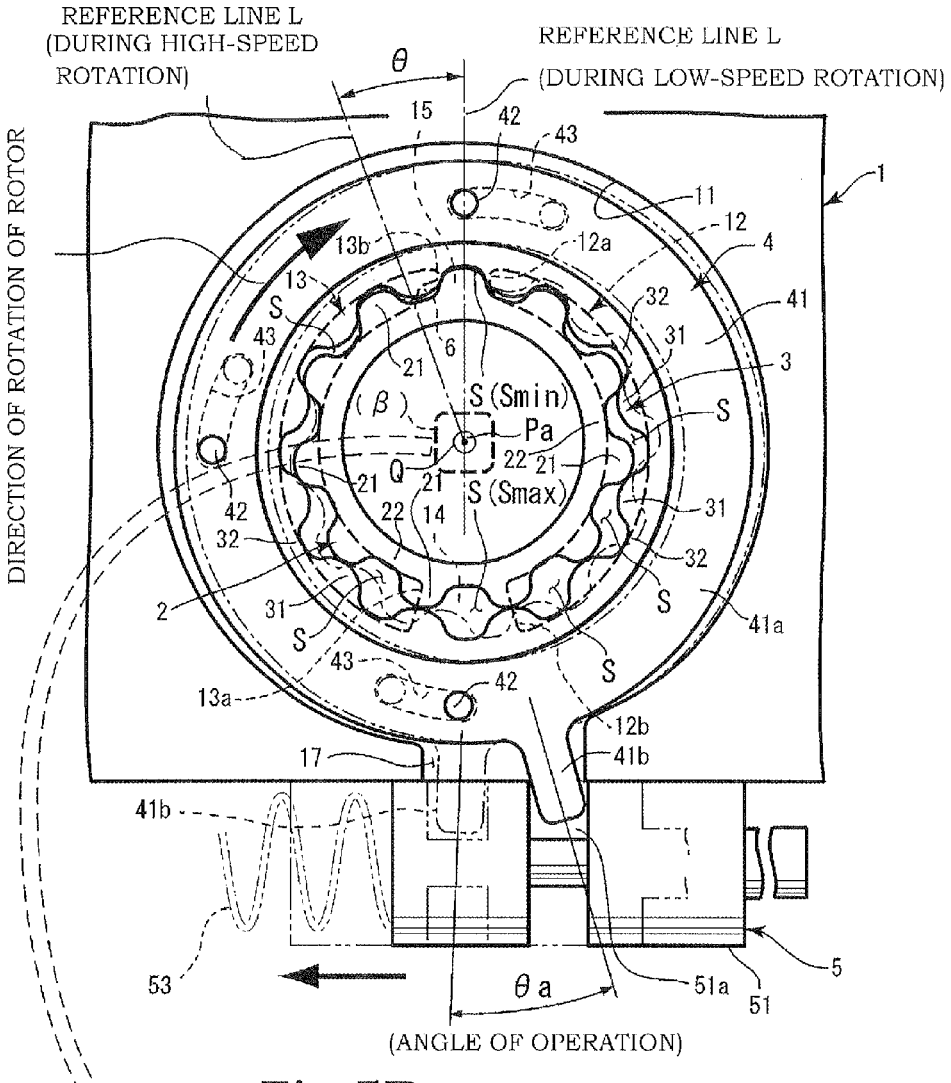
FIG. 5A is an enlarged front view diagram showing a composition of an inner rotor, an outer rotor, a guide mechanism, an adjustment mechanism and a pump housing according to the present invention.

During one revolution of the rotor chamber 11, the respective volume of each space between teeth S expands and contracts. The space between teeth S at which the volume is a maximum is called the maximum space between teeth Smax, and the space between teeth S at which the volume is a minimum is called the minimum space between teeth Smin. Due to the operation of the guide mechanism 4, the position of the center of rotation Pb of the outer rotor 3 with respect to the center of rotation Pa of the inner rotor 2 changes between low-speed rotation and high-speed rotation (see FIG. 2 and FIG. 5).

Consequently, the position of the maximum space between teeth Smax and the position of the minimum space between teeth Smin also change. More specifically, during low-speed rotation, the minimum space between teeth Smin is formed on the second partitioning section 15 and the maximum space between teeth Smax is formed on the first partitioning section 14. Moreover, during high-speed rotation, the minimum space between teeth Smin is formed in the vicinity of the second partitioning section 15, within the range of the discharge port 13 which is on the rear side in terms of the direction of rotation of the inner rotor 2 and the outer rotor 3, and the maximum space between teeth Smax is formed in the vicinity of the first partitioning section 14, within the range of the intake port 12 which is on the rear side in terms of the direction of rotation of the inner rotor 2 and the outer rotor 3.

The minimum space between teeth Smin described above is in a state where an outer tooth 21 of the inner rotor 2 penetrate in between adjacent inner teeth 31 of the outer rotor 3 (in other words, into the tooth valley 32 portion). At the minimum space between teeth Smin, the points of contact between the outer tooth 21 of the inner rotor 2 and the inner teeth 31 of the outer rotor 3 (in actual practice, there is a very small tip clearance) are called contact points Cf, Cr. The contact point Cf is on the forward side in terms of the direction of rotation of the inner rotor 2 (or the outer rotor 3) and contact point Cr is on the rear side (see FIG. 1B and FIG. 2).

If the width direction dimension between the contact points Cf, Cr which constitutes the space between teeth S passing the second partitioning section 15 during low-speed rotation (in actual practice, this is the minimum space between teeth Smin) is taken to be W1, then the gap dimension Wa of the second partitioning section 15 in the width direction (which is the same as the direction of rotation of the inner rotor 2) is formed to be the same as or slightly larger than the gap W1 of the minimum space between teeth Smin (see FIG. 1B). In other words, $$Wa \geq W1.$$

A protruding surface section 6 is formed on the rotor inner diameter side of the trailing end section 13*b* of the discharge port 13 (see FIG. 1 to FIG. 3). More specifically, the protruding surface section 6 is a flat surface which is formed in the same plane as and continuously with the second partitioning section 15, from the vicinity of the inner diameter side 13*i* of the trailing end section 13*b* of the discharge port 13.

The protruding surface section 6 serves to support the portion that projects beyond the second partitioning section 15, in a hermetically sealed state, when the space between teeth S, which is formed by the inner rotor 2 and the outer rotor 3 in a state where the reference line L has rotated through an angle of θ in a direction opposite to the direction of rotation of the inner rotor 2 and the outer rotor 3, passes the second partitioning section 15 during high-speed rotation.

Figure 2B:
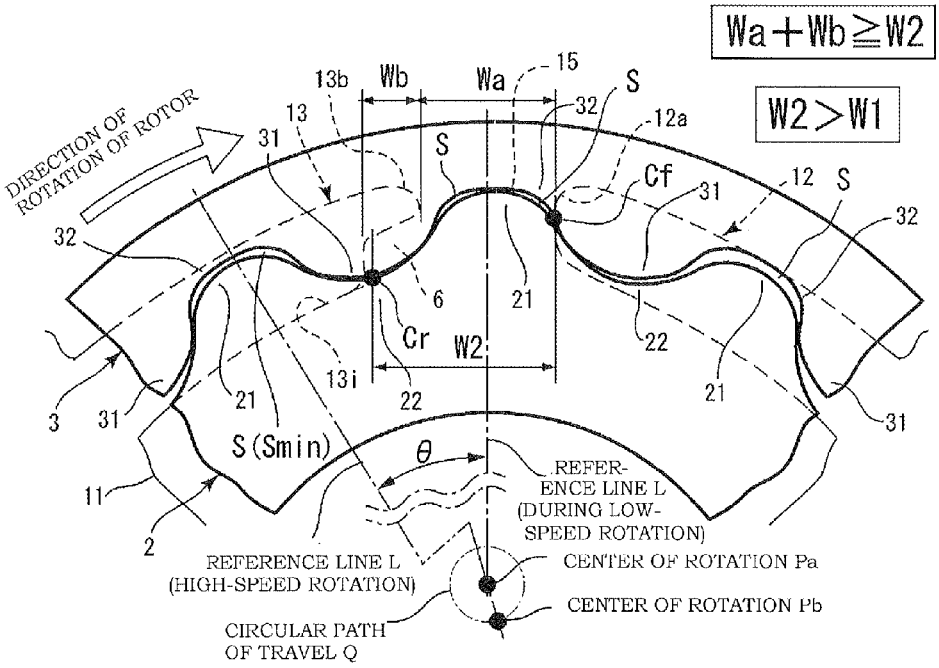
FIG. 2B is a principal enlarged diagram showing a space between teeth which is constituted by an inner rotor and an outer rotor, and a second partitioning section, during high-speed rotation in the present invention.

Consequently, the combined range of the width direction of the protruding surface section 6 (the width direction being the same as the direction of rotation of the inner rotor 2) and the width direction of the second partitioning section 15 is greater than the formation range of the space between teeth S which is constituted by the inner rotor 2 and the outer rotor 3 during high-speed rotation (see FIG. 2B and FIG. 3).

If the dimension of the protruding surface section 6 in the width direction (which is the same as the direction of rotation of the inner rotor 2) is taken to be Wb, and the dimension, in the width direction, of the formation range of the space between teeth S constituted by the inner rotor 2 and the outer rotor 3 during high-speed rotation is taken to be W2, then $$Wa+Wb \geq W2.$$

Here, the width direction dimension W1 during low-speed rotation and the width direction dimension W2 during high-speed rotation, of the space between teeth S when passing the second partitioning section 15, are determined by the two contact points Cf, Cr in the direction of rotation of the outer teeth 21 of the inner rotor 2 and the inner teeth 31 of the outer rotor 3. The gap (dimension W2) of the space between teeth S during high-speed rotation of the inner rotor 2 and the outer rotor 3 is greater than the gap (dimension W1) of the space between teeth S during low-speed rotation (see FIG. 2B). In other words, $$W2>W1.$$

As described above, the protruding surface section 6 is formed continuously with the second partitioning section 15, and is formed within the discharge port 13. Furthermore, as described above, the protruding surface section 6 is a portion which supports and covers the formation range of the space between teeth S passing the second partitioning section 15.

In particular, the space between teeth S which passes the second partitioning section 15 during high-speed rotation is formed in a range that extends in the opposite direction to the direction of rotation, compared the space between teeth S which passes the second partitioning section 15 during low-speed rotation, and in this state, the space between teeth S projects beyond the second partitioning section 15. The protruding surface section 6 serves to cover the portion of the space between teeth S that projects beyond the second partitioning section 15. The shape of the protruding surface section 6 can be made substantially the same as the projecting portion of the space between teeth S described above.

Figure 3A:
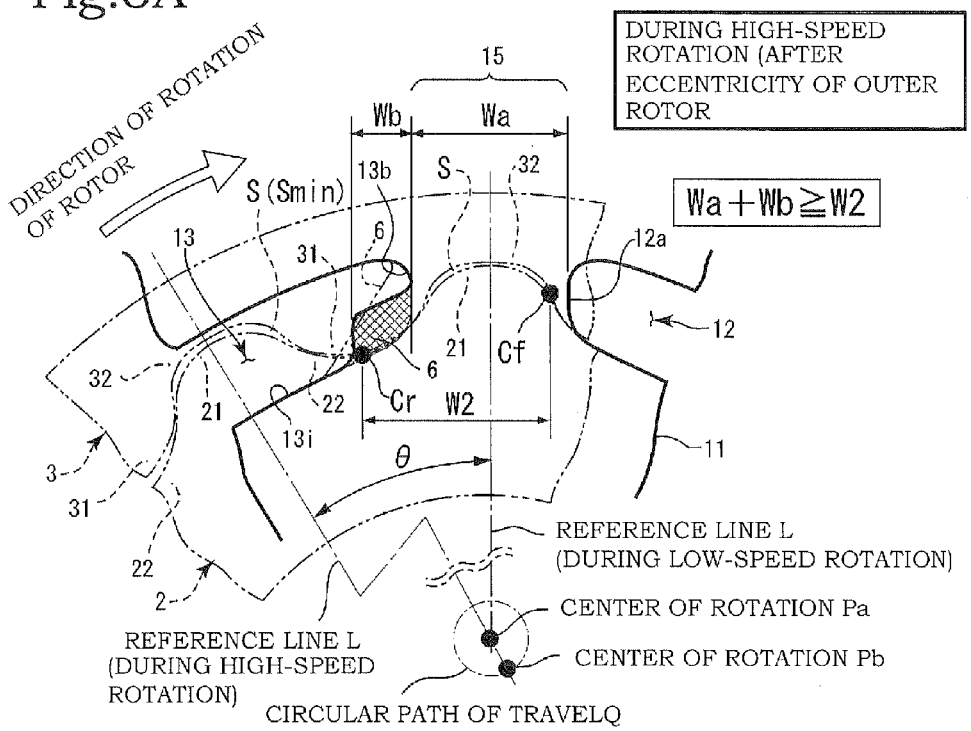
FIG. 3A is a principal enlarged diagram showing a second partitioning section having a quadrangular or triangular protruding surface section and a space between teeth during high-speed rotation.
Figure 3B:
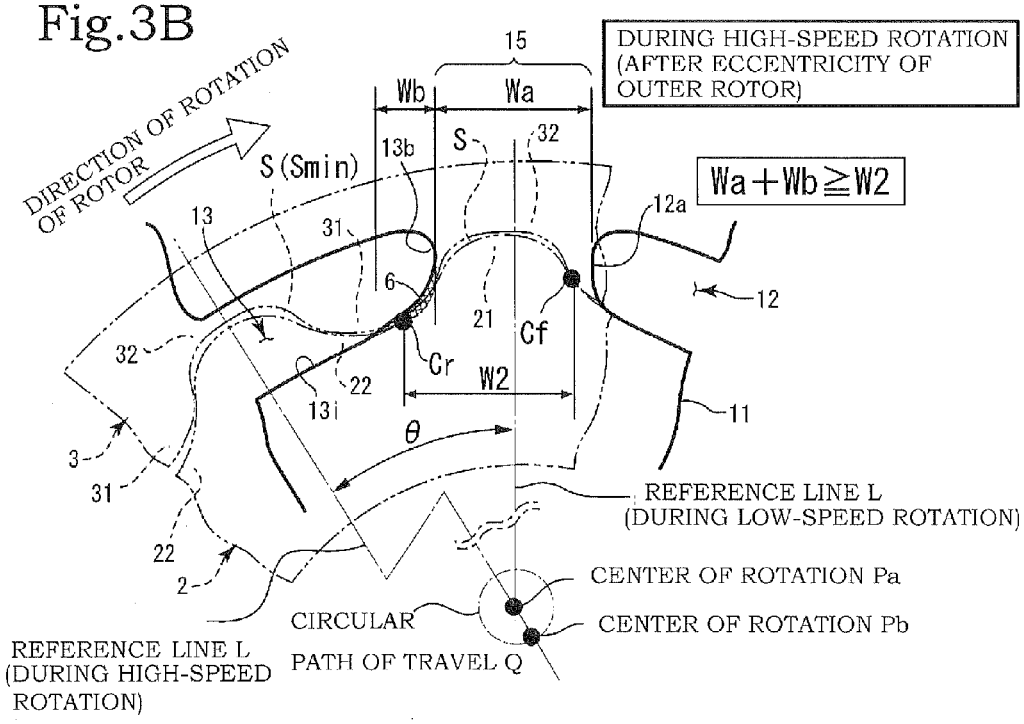
FIG. 3B is a principal enlarged diagram showing a second partitioning section having a shape in which the protruding surface section substantially matches the path of travel of the space between teeth, and the space between teeth during high-speed rotation.

The protruding surface section 6 can be formed into a shape following the path of movement on the rear side in the direction of rotation, of the space between teeth S constituted by the inner rotor 2 and the outer rotor 3 upon passing the second partitioning section (see FIG. 3B). More specifically, it is possible to form the protruding surface section 6 to a shape following the path of movement of the contact point Cr on the rear side in the direction of rotation of the space between teeth S.

Furthermore, the protruding surface section 6 may also be formed into a substantially quadrangular shape (see FIG. 3A). In this case, the protruding surface section 6 is formed to be larger than the portion of the space between teeth S that projects from the second partitioning section 15 during high-speed rotation. Moreover, the protruding surface section 6 may also be formed into a substantially triangular shape (see the virtual image lines in FIG. 3A).

Furthermore, as shown in FIG. 5, the guide mechanism 4 serves to rotate the reference line L linking the center of rotation Pa of the inner rotor 2 and the center of rotation Pb of the outer rotor 3, and the adjustment mechanism 5 serves to operate the guide mechanism 4.

An outer ring 41 which forms the guide mechanism 4 is arranged on the inside of the rotor chamber 11 (see FIG. 4). The outer ring 41 is constituted by a ring-shaped main body section 41*a* which is formed into a circular ring shape and a projecting section 41*b* which is formed into a projecting shape at a suitable location on an outer circumference of the ring-shaped main body section 41*a*. The outer ring 41 accommodates the outer rotor 3 in a rotationally slidable fashion on the inner circumference side of the ring-shaped main body section 41*a*.

A projecting section 41*b* which is provided in a projecting fashion in one portion of the outer circumference portion of the outer ring 41 is arranged so as to project into the adjustment mechanism accommodating section 16 via the connecting chamber 17 which is formed in the rotor chamber 11 (see FIG. 4A). Furthermore, a plurality of guide pins 42 are provided in the outer ring 41, and guide grooves 43 of equal number to the guide pins 42 are formed in the rotor chamber 11 (see FIG. 4B). The guide grooves are formed as elongated holes having a circular arc shape. The guide pins 42 are inserted into the guide grooves 43 and the outer ring 41 moves along the guide grooves 43.

The connecting chamber 17 is formed into the shape of a broad groove which is larger than the width of the projecting section 41*b*, in such a manner that the projecting section 41*b* can rotate in the direction of the circumference of the outer ring 41. The outer ring 41 is composed so as to be elastically impelled at all times in an opposite direction to the direction of rotation of the outer rotor (the counter-clockwise direction in FIG. 4A) by a spring member 53 of the adjustment mechanism 5 which is accommodated the adjustment mechanism accommodating section 16.

Figure 5B:
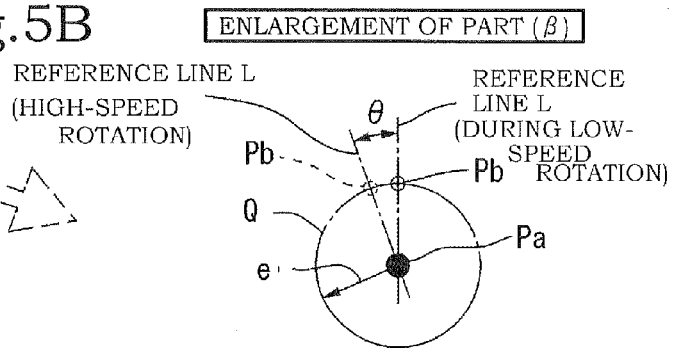
FIG. 5B is an enlarged diagram of portion (β) in FIG. 5A.

In the outer rotor 3, the center of rotation Pb rotates along a path which maintains a prescribed amount of eccentricity e with respect to the center of rotation Pa of the inner rotor 2, and furthermore the reference line L also rotates (see FIG. 5). The prescribed path described above is a circular path Q of which the radius is equal to an amount of eccentricity e and the center of rotation Pa of the inner rotor 2 is the center of the diameter of the path (see FIG. 5B).

The center of rotation Pb of the outer rotor 3 rotates following the circular path of travel Q, while the center of rotation Pa of the inner rotor 2 and the amount of eccentricity e are kept uniform (see FIG. 5B). In other words, the center of rotation of the reference line L is the center of rotation Pa, and the outer rotor 3 rotates due to the guide mechanism 4 in accordance with the state of rotation of the angle θ. FIG. 2B, FIG. 3 and FIG. 5 show the reference lines L for both low-speed operation and high-speed operation of the pump.

Furthermore, the space between teeth S which passes the reference line L is a maximum space between teeth Smax on one side of the center of rotation Pa of the reference line L, while the minimum space between teeth Smin is positioned on the other side of the center of rotation Pa. This state remains the same even if the reference line L rotates and however the angle changes (see FIG. 5A).

Possible examples of the adjustment mechanism 5 use a valve, a spring, a gear, or the like, but here, an example using a valve is described. Apart from a valve which rotates the outer ring 41 by hydraulic pressure, it is also possible to use a solenoid valve, or the like. The adjustment mechanism 5 is held slidably inside the adjustment mechanism accommodating section 16 which is formed into a substantially cylindrical shape above the rotor chamber 11.

Furthermore, the adjustment mechanism 5 is constituted by a cylindrical valve main body 51, a bolt 52 which seals the open end of the adjustment mechanism accommodating section 16, and a spring member 53 one end of which makes elastic contact with the bolt 52 and the other end of which makes elastic contact with the valve main body 51, thereby elastically impelling the outer ring 41 in an opposite direction to the direction of rotation of the outer rotor. A holding section 51*a* having a constricted shape with a small diameter dimension is formed in substantially the center of the valve main body 51, and a projecting section 41*b* of the outer ring 41 is arranged in the holding section 51*a*.

During low-speed rotation of the pump, when the inner rotor 2 and the outer rotor 3 rotate while the outer teeth 21 and inner teeth 31 thereof respectively mesh with each other due to the rotation of the drive axle, the space between teeth S expands on the side of the intake port 12, and after passing the first partitioning section 14, contracts on the side of the discharge port 13, and a pumping action is performed by this change in volume.

Here, the direction of rotation of the rotor according to the present invention is the clockwise direction in the drawings. When the pump is rotating at low-speed, the projecting section 41*b* which is arranged on the holding section of the valve main body 51 is pressed and impelled by the spring force of the spring member 53 of the adjustment mechanism 5 and therefore the outer ring 41 is impelled to rotate in the counter-clockwise direction.

During low-speed rotation of the inner rotor 2 and the outer rotor 3, the outer ring 41 supports the outer rotor 3 in such a manner that the reference line L formed by the center of rotation Pa of the inner rotor 2 and the center of rotation Pb of the outer rotor 3 passes through the central position of the width direction of the first partitioning section 14 and the central position of the second partitioning section 15.

Consequently, the space between teeth S has a maximum volume when passing the first partitioning section 14 and has a minimum volume when passing the second partitioning section 15, and in this case the pump discharge volume becomes a maximum. When the inner rotor 2 and the outer rotor 3 are rotating at high speed, the projecting section 41*b* of the outer ring 41 rotates through an operating angle θa about the center of the diameter of the outer ring 41, due to the operation of the adjustment mechanism 5, and the center of rotation Pb of the outer rotor 3 moves along a circular path of travel Q about the center of rotation Pa of the inner rotor 2 (see FIG. 5A).

In this case, the reference line L which links the center of rotation Pa and the center of rotation Pb rotates through an angle of θ. Consequently, the position where the maximum space between teeth Smax passes is at an angle of θ to the rear side of the central position of the width direction of the first partitioning section 14, in terms of the direction of rotation, and the position where the minimum space between teeth Smin passes is at an angle of θ to the rear side of the central position of the width direction of the second partitioning section 15, in terms of the direction of rotation. In this state, the space between teeth S which passes the second partitioning section 15 is longer in the direction of rotation and has a slightly larger dimension in the width direction, than the minimum space between teeth Smin.

The gap Wa from the trailing end section 13*b* of the discharge port 13 to the second partitioning section 15 in the leading end section 12*a* of the intake port 12 is set to a gap substantially the same as, or slightly larger than, the gap W1 between the contact points Cf, Cr of the minimum space between teeth Smin which passes the second partitioning section 15 during low-speed rotation. Consequently, the minimum space between teeth Smin passes over the second partitioning section 15 without giving rise to pumping loss and without connecting between the intake port 12 and the discharge port 13 (see FIG. 3A).

When the pump discharge pressure rises as the speed of the pump increases, the pump discharge pressure presses the front end side of the valve main body 51 and the valve main body 51 moves to the side of the spring member 53 due to a force created by the pump discharge pressure which exceeds the elastic force of the spring member 53.

The holding section also moves to the right side, simultaneously with the valve main body 51. Accordingly, the projecting section 41*b* of the outer ring 41 also moves to the right side, and the outer ring 41 rotates in the counter-clockwise direction against the spring force. In other words, the outer ring 41 rotates in the opposite direction to the direction of rotation of the rotor. The outer ring 41 stops rotating at a position where the force created by the pump discharge pressure balances with the spring force of the spring member 8*c*.

By this means, the center of rotation Pb of the outer rotor 3 is eccentric by an angle of θ with respect to the center of rotation Pa of the inner rotor 2. During high-speed rotation, the volume of the space between teeth S of the inner rotor 2 and the outer rotor 3 decreases from the discharge port 13, while oil is discharged, but since the reference line L rotates in an opposite direction to the direction of rotation of the rotor, then a space between teeth S in a preceding position on the intake side is positioned on the second partitioning section 15, rather than the minimum space between teeth Smin where the volume is a minimum.

The contact points Cf, Cr of the space between teeth S on the second partitioning section 15 have a positional relationship which is separated by the gap Wa of the leading end section 12*a* of the intake port 12 from the trailing end section 13*b* of the discharge port 13. However, since the protruding surface section 6 is formed on the inner diameter side of the trailing end section 13*b* of the discharge port 13, then the space between teeth S is able to pass over the second partitioning section 15 without connecting between the discharge port 13 and the intake port 12.

As described above, due to the protruding surface section 6, the space between teeth S which is positioned over the second partitioning section 15 during high-speed rotation can pass without causing pumping loss during low-speed rotation, and can also pass without connecting the discharge port 13 and the intake port 12, during both low-speed rotation and high-speed rotation, and therefore no unnecessary work is performed, and the discharge volume can be varied while preventing decline in the pump efficiency.

What is claimed is:

1. An oil pump which changes an amount of fluid transferred from an intake port to a discharge port in one rotation, by causing a rotation of a reference line linking centers of rotation of an inner rotor and an outer rotor, the oil pump comprising:

a pump housing in which a first partitioning section is formed between a trailing end section of the intake port and a leading end section of the discharge port, and a second partitioning section is formed between a trailing end section of the discharge port and a leading end section of the intake port, a width dimension of the second partitioning section is formed to be the same as or larger than a formation range of a space between teeth which is constituted by the inner rotor and the outer rotor passing the second partitioning section during a low-speed rotation, a protruding surface section is formed in a same plane as and continuously with the second partitioning section from a vicinity of an inner diameter side of the trailing end section of the discharge port, the protruding surface section is formed other than in the leading end section of the intake port, the protruding surface section and the second partitioning section are formed to be the same as or larger than the formation range of the space between teeth which passes the protruding surface section and the second partitioning section during a high-speed rotation, the space between teeth does not connect with the discharge port and the intake port above the second partitioning section, both before and after the rotation of the reference line; and the protruding surface section is formed into a shape following a path of a travel of a contact point between the teeth of the inner rotor and the outer rotor on a rear side in a direction of rotation of the inner rotor and the outer rotor when the space between teeth which is constituted by the inner rotor and the outer rotor passes the second partitioning section during high-speed rotation.

2. The oil pump according to claim 1, wherein the protruding surface section is formed into a quadrangular shape.

3. The oil pump according to claim 1, wherein the protruding surface section is formed into a triangular shape.

4. The oil pump according to claim 1, wherein the protruding surface section is formed in the trailing end section of the discharge port.

5. The oil pump according to claim 1, wherein the protruding surface section is formed only in the trailing end section of the discharge port.

6. The oil pump according to claim 1, wherein during the low-speed rotation before the rotation of the reference line and during the high-speed rotation after the rotation of the reference line, the space between teeth passes over the second partitioning section.

7. The oil pump according to claim 1, wherein during the low-speed rotation before the rotation of the reference line and during the high-speed rotation after the rotation of the reference line, the space between teeth passes over the second partitioning section without connecting with the discharge port.

8. The oil pump according to claim 1, wherein during the low-speed rotation before the rotation of the reference line and during the high-speed rotation after the rotation of the reference line, the space between teeth passes over the second partitioning section without connecting with the intake port.

9. The oil pump according to claim 1, wherein the oil pump is an eccentric variable-capacity pump.

* * * * *